United States Patent [19]

Roberts

[11] 4,454,448

[45] Jun. 12, 1984

[54] INTER-CHANNEL ISOLATION SCHEME FOR COMPACT, FOLDED DISCHARGE LAMPS

[75] Inventor: Victor D. Roberts, Burnt Hills, N.Y.

[73] Assignee: General Electric Company, Schenectady, N.Y.

[21] Appl. No.: 339,956

[22] Filed: Jan. 18, 1982

[51] Int. Cl.[3] ..... H01J 61/30; H01J 61/42

[52] U.S. Cl. ..... 313/493

[58] Field of Search ..... 313/493, 610, 612, 573, 313/634

[56] References Cited

U.S. PATENT DOCUMENTS

| | | | |
|---|---|---|---|
| 4,093,893 | 6/1978 | Anderson | 313/341 X |
| 4,095,135 | 6/1978 | Yamazaki et al. | 313/493 |
| 4,173,730 | 11/1979 | Young et al. | 313/610 X |
| 4,182,975 | 1/1980 | Young | 313/610 X |
| 4,184,101 | 1/1980 | Young | 313/493 X |
| 4,185,221 | 1/1980 | Young | 313/610 X |
| 4,196,374 | 4/1980 | Witting | 313/610 X |
| 4,311,943 | 1/1982 | Gross et al. | 315/70 |

FOREIGN PATENT DOCUMENTS

| | | | |
|---|---|---|---|
| 974453 | 12/1960 | Fed. Rep. of Germany | 313/610 |
| 273533 | 5/1951 | Switzerland | 313/610 |

*Primary Examiner*—Palmer C. Demeo

*Attorney, Agent, or Firm*—William H. Steinberg; James C. Davis, Jr.; Marvin Snyder

[57] ABSTRACT

In a folded discharge fluorescent lighting device, inter-channel isolation means are provided by proper selection of the length and diameter of a secondary path. The diameter of this path, in particular, is chosen to be small to increase the electrical resistance along this path and to thereby cause the arc discharge to follow the main current pathway. The small diameter promotes rapid recombination of ion pairs, thus acting to increase the resistance of this secondary path. Likewise, in another embodiment of the present invention, a volume between the main channels is filled with an ion recombination enhancement material such as glass fibers or glass wool. The present invention may be configured in the approximate shape of a conventional incandescent lamp or may even take the form or a flat fluorescent panel.

4 Claims, 4 Drawing Figures

INTER-CHANNEL ISOLATION SCHEME FOR COMPACT, FOLDED DISCHARGE LAMPS

BACKGROUND OF THE INVENTION

This invention relates to fluorescent lamps and, more particularly, to folded discharge fluorescent lamps and inter-channel isolation means.

In response to increasing energy costs, greater than average efforts have been expended in recent years on the development of more efficient lighting devices. In particular, it is appreciated that conventional fluorescent lighting is an efficient alternative to the incandescent lamp. However, for efficient operation, the ratio of the discharge path length to the discharge path diameter in a fluorescent lamp must be carefully selected to avoid decreasing lamp efficacy. In particular, this ratio of length-to-diameter (L/D) is typically between 10 and 90 for conventional fluorescent lamps. Accordingly, it should therefore be appreciated that these efficacy constraints have generally resulted in the long cylindrical fluorescent lamps that are now commonplace featues. However, efforts to replace conventional incandescent lamps with appropriately-rated fluorescent lamps have proven to be a significant manufacturing and engineering challenge.

For example, in U.S. Pat. No. 4,095,135, issued June 13, 1978 to Yamazaki et al., there is apparently described a spherical-bulb fluorescent lamp apparently solving some of the problems associated with folded discharge lamps. Similarly, in U.S. Pat. No. 4,196,374, issued Apr. 1, 1980 to Harald L. Witting, there is disclosed a compact folded discharge fluorescent lamp comprising a substantially cylindrical tapered envelope with correspondingly tapered partitions disposed within the envelope so as to define the folded discharge path. Other solutions to the problem of producing a compact fluorescent lamp have been solved by the use of so-called short arc fluorescent lamps possessing large envelope areas to reduce phosphor loading and specially-designed electrodes to maximize arc length and to minimize sputtering of cathode material which may otherwise occur in the low pressure environments employed in such lamps. See U.S. Pat. No. 4,093,893, issued June 6, 1978 to John M. Anderson.

One of the more significant approaches taken to the problem of developing compact fluorescent lamps is the use of the so-called folded discharge design in which the length of the discharge arc path is increased through the use of geometric means which force the arc into a convoluted path, often doubling back on itself, so as to increase the effective length of the discharge column, and, accordingly, to increase the value of the ratio L/D as discussed above. The most significant problem arising in the folded arc discharge concept, however, is the isolation of various parts of the folded discharge from other parts of the folded discharge. One solution to this problem appears to be disclosed in U.S. Pat. No. 4,191,907, issued March 4, 1980 to Rogoff. In this patent there is apparently disclosed a discharge bypassing prevention method employing partition panels including gaskets of feltlike material at the edges of the partition panels. A similar scheme appears to be disclosed in U.S. Pat. No. 4,184,101, issued Jan. 15, 1980 to Young. A still further example of such a gasket sealing design is shown in U.S. Pat. No. 4,182,975, issued Jan. 8, 1980 to Young. Other compact folded discharge lamps are also described in U.S. Pat. No. 4,173,730, issued Nov. 6, 1979 to Young et al. and also in U.S. Pat. No. 4,185,221, issued Jan. 22, 1980 to Young. However, all of these designs depend upon a relatively tight seal between partitioned members and an outer envelope wall to prevent the arc from taking short-cut paths and thus avoiding one or more of the folded segments of the arc discharge column. Such is not the case in the present invention which avoids these problems but yet which provides a design which is readily manufacturable.

SUMMARY OF THE INVENTION

In accordance with a preferred embodiment of the present invention, a fluorescent lighting device comprises an evacuable light-transmissive envelope having a main discharge path having a predetermined L/D ratio together with an ionizable medium disposed within the envelope and at least one pair of electrodes disposed at opposite ends of the main discharge path. Additionally, the lighting device of the present invention includes a secondary path also defined by the envelope, in gaseous communication with the main discharge path, with the secondary path having a selected length-to-diameter ratio so that the secondary path exhibits a higher resistance to electrical discharge current flow than the main discharge path. In this way, the arc, following a path of least resistance, remains in the main lamp channels. Additionally, the lamp of the present invention offers significant ease of manufacture, both in terms of lack of critical tolerances and in energy saved through the elimination of various glass fusing requirements. In the present invention, the envelope is formed from substantially two sheets, at least one of which has channels for defining a main discharge path together with at least one ridge between the channels, with the other of the sheets possessing a channel which is complementary to the ridge portion so as to define the secondary path exhibiting the higher resistance. In accordance with another embodiment of the present invention, the lighting device envelope is formed from two sheets as described above, but instead of possessing a ride portion, instead possesses at least one minor channel in at least one of the sheets so as to define a volume between the main channels in gaseous communication with them. In this latter embodiment, this volume contains an ion recombination enhancement material such as glass fiber or glass wool. In both of these embodiments, the discharge path is determined by structures which effect the loss/recombination rate for charged particles in an ionized plasma. In the first embodiment, this loss/recombination rate is controlled primarily by the selection of a small diameter for the secondary path, relative to its length; and in the second embodiment the loss/recombination rate is controlled by the presence of recombination surfaces, such as fibers introduced into specific portions of the discharge region. Additionally, the lighting device of the present invention is extremely easy to manufacture and preferably includes a phosphor disposed on the interior of the envelope wall. The lighting device of the present invention may be configured in the shape of a conventional incandescent lamp or a number of such channels may be provided on a flat panel illuminating device.

Accordingly, it is an object of the present invention to provide isolation means for adjacent channels in folded compact fluorescent lamps.

It is also an object of the present invention to provide a structure for a flat lighting panel.

Additionally, it is an object of the present invention to produce a lighting device which is readily manufacturable and which employs minimal energy resources for lamp sealing operations.

It is also an object of the present invention to provide a folded discharge lamp structure in which close manufacturing tolerances are not required.

Lastly, it is an object of the present invention to provide an energy efficient light source.

DESCRIPTION OF THE FIGURES

The subject matter which is regarded as the invention is particularly pointed out and distinctly claimed in the concluding portion of the specification. The invention, however, both as to organization and method of practice, together with further objects and advantages thereof, may best be understood by reference to the following description taken in connection with the accompanying drawings in which:

DETAILED DESCRIPTION OF THE INVENTION

Figure 1:
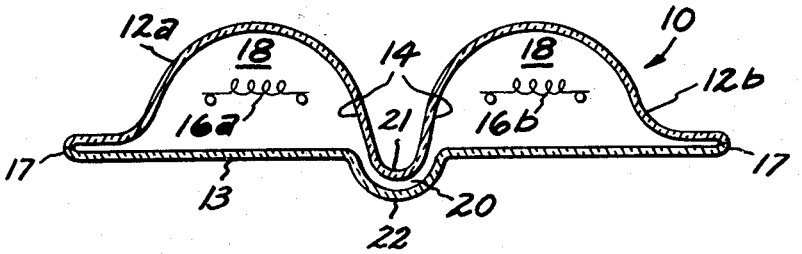
FIG. 1 is a cross-sectional plan view illustrating one embodiment of the present invention.

FIG. 1 illustrates one embodiment of the lighting device 10 of the present invention. The most significant aspect of this embodiment is the configuration of the lighting device envelope which comprises an evacuable light-transmissive material, such as glass. The envelope is formed from two separate pieces, upper portions 12*a* and 12*b*, collectively referred to by reference number 12, and lower portions 13. Upper portion 12 comprises channels 12*a* and 12*b* serving to form the principal portion of the main discharge path. The remainder of the device envelope comprises lower portion 13. A significant advantage of the device of the present invention is that upper portion 12 and lower portion 13 need be joined together only along edges 17. There is no requirement in the present invention for complete isolation of gaseous or plasma material in the two main channels. This is a direct consequence of ridge portion 21 on upper envelope portion 12 together with channel portion 22 on the lower envelope portion 13. Ridge 21 and channel 22 are complementarily-shaped surfaces acting together to form secondary path 20 between electrodes 16*a* and 16*b* which are disposed at opposite ends of the main discharge path. The length and diameter of secondary path 20 are selected so that secondary path 20 exhibits a higher resistance to electrical discharge current flow than the main discharge path. In this way, because of the high ion recombination rate occurring in the small diameter path 20, this path is made to exhibit a much higher resistance to the discharge arc and, accordingly, the arc remains in the main discharge channel. This structure does not require high tolerance matching for the secondary path. In short, there is no necessity for sealing or otherwise gasketing this secondary path primarily because of its relatively long length. These two lamp envelop pieces are fabricated separately and readily joined along edges 17 in a single heating process. A significant amount of energy and effort are saved in not having to fuse the envelope portion together at selective portions along secondary path 20. Additionally, the structure of the present invention renders it not only applicable to compact fluorescent lamp designs as are illustrated in FIGS. 1–4, but also make it particularly useful in the construction of flat fluorescent lighting panels. In such panels a plurality of channels and ridges are provided in one portion of the device envelope and other minor channels corresponding to ridges are provided in a second envelope portion to which sealing is required only at the edges and not along inner portions.

In addition to the particular envelope configuration shown in FIG. 1, there is also shown therein electrodes 16*a* and 16*b* which are disposed at opposite ends of a main discharge path. Also shown is ionizable medium 18 disposed within the sealed envelope comprising upper portion 12 and lower portion 13. Phosphor coating 14 is also preferably disposed on the inner portion of the envelope. The electrodes, phosphor and ionizing medium are elements which are conventionally and commonly employed in the fluorescent lamp arts.

Figure 2:
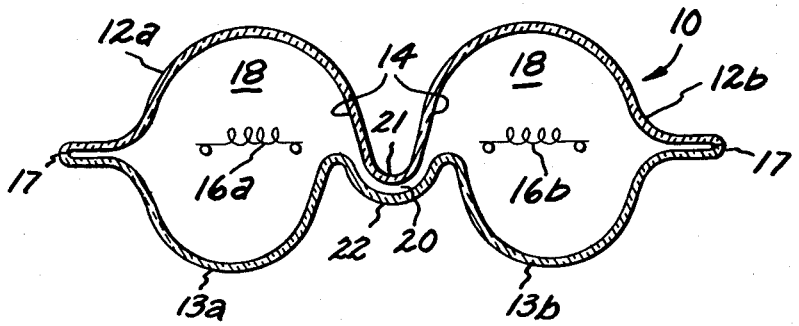
FIG. 2 is a view similar to FIG. 1 in which more symmetric envelope halves are employed.

FIG. 2 illustrates an embodiment of the present invention similar to that shown in FIG. 1. In the embodiment shown in FIG. 1, a lower envelope portion 13 is fashioned in the form of a relatively flat sheet. This design is particularly useful in the construction of flat panel fluorescent light sources. However, it is also possible to fabricate lower portion 13 in a shape which is somewhat more symmetrical with respect to upper portion 12. In particular, lower portion 13 may also possess channel-forming portions 13*a* and 13*b* which cooperate with corresponding portions 12*a* and 12*b* of the upper envelope portion of form the main discharge channel in the lighting device. Again, as in the embodiment shown in FIG. 1, secondary channel 20 is formed as a result of mating of the two envelope portions. Channel 20 is accordingly selected to have a length and a diameter such that ion recombination strongly occurs in this relatively confined region so that the effective resistance to electrical discharge current flow through the secondary path is higher than the effective resistance of the discharge path through the main channels.

Figure 3:
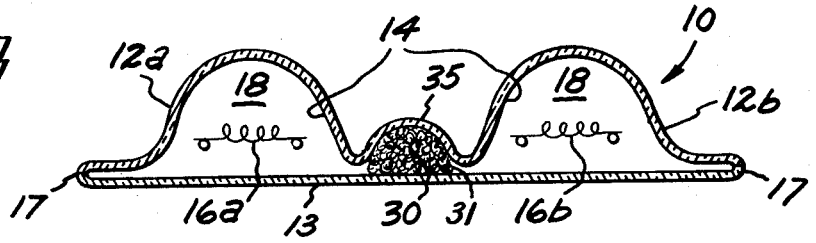
FIG. 3 is a cross-sectional plan view of an embodiment of the present invention employing an ion recombination enhancement material.
Figure 4:
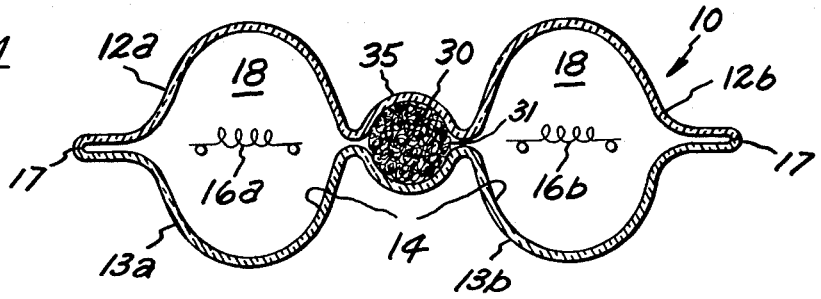
FIG. 4 is a view similar to FIG. 3 but again illustrating more symmetric envelope portions.

FIG. 3 illustrates yet another embodiment of the present invention. In this embodiment, as above, the effective resistance of a secondary path is effectively increased through the encouragement of ion recombination. In the embodiments illustrated in FIGS. 3 and 4, this ion recombination is enhanced through the use of a material providing a large number of recombination sites. In the embodiment shown in FIG. 3, lower envelope portion 13 is substantially flat while upper envelope portion 12 includes channel portion 35 which cooperates with the lower portion of the envelope, when assembled, to form volume 30 lying between the main discharge channels and in gaseous communication with them. However, in the embodiments shown in FIGS. 3 and 4, there is disposed in this volume ion recombination enhancement material 31. This material preferably includes a substance such as glass fiber or glass wool. The embodiment shown in FIG. 4 is similar to that shown in FIG. 3 in function and construction except that lower enevelope portion 13 includes channel portion 13*a* and 13*b* which cooperate with the channel portions 12*a* and 12*b* of upper envelope portion 12, respectively, to define the main discharge channels.

The folded discharge lamp of the present invention is distinguishable over other folded lamp discharge designs in that other designs rely on close mechanical fit to prevent interchannel short circuiting of the arc discharge. In the present design, there is no requirement for an inner structure which fits tightly against an outer shell or other similar mechanical sealing approach. The problems with these approaches is that tight mechanical tolerances are required and many of these designs often result in the problem that phosphpr is rubbed off the glass surfaces as they are assembled. Such is not the case in the present invention. Since even small gaps in the interchannel isolation barriers employed in previous designs may allow the discharge to pass through, a second method of interchannel isolation utilizes glass-to-glass fusion seals. While fusion seals do eliminate interchannel shorts, they require heating of all parts to a high temperature and are expensive both from an energy and an equipment point of view. In contrast, the present invention does not require close mechanical fitting during lamp manufacture. Furthermore, it does not require a form of assembly in which phosphor is rubbed off mating surfaces. Lastly, and most importantly from a manufacturing viewpoint, the lighting device of the present invention does not require close mechanical fit between mating pieces. Instead, interchannel isolation is achieved through the use of selective determination of appropriate length and diameter ratios for a secondary path. It is noted that this path is not referred to herein as a discharge path since it is dimensioned so that the discharge flow is instead through the main discharge channel which is selected to have an appropriate length-to-diameter ratio. In general, this ratio is preferably greater than 10 and generally less than 90, for most efficient fluorescent lamp operation. Furthermore, since the glass or quartz wool employable as an ion recombination enhancement material is soft and compressible, mating the parts do not have to be manufactured to high tolerance, particularly in the embodiments shown in FIGS. 3 and 4.

The ion recombination enhancement material usable in the present invention is characterized by having a low vapor pressure and resistance to heat. Additionally, it should also be nonreactive with mercury or other ionizable medium components. Refractory materials, particularly those manufacturable in fiber form, are especially useful.

The present invention also exhibits significant advantages in direct current operation. In particular, the channels in the present invention provide a return path for un-ionized mercury vapor. This return path is highly desirable in direct current lamp operation since there is a strong tendency for the discharge to "pump" mercury from the anode to the cathode region of the lamp.

While the discussions above have referred to channel diameter, this should not be interpreted as meaning that these channels necessarily have a circular cross section. In the noncircular situation, it should be appreciated that it is the smaller cross-sectional dimensions which mainly determine the diffusion rate of the ionized vapor.

From the above it may be appreciated that the present invention provides a compact folded-discharge, fluorescent lighting device configurable either as a conventional lamp or in the form of a flat panel device. Furthermore, it is also seen that the interchannel isolation method employed in the present invention is significantly different from those employed in other folded discharge lamp designs. In particular, the present invention offers significant improvements in manufacturing ease. Yet, the manufacturing methods empolyable with the present invention are, nonetheless, economical and do not require exotic or expensive materials. Additionally, it should be noted that the embodiments shown in FIG. 4 are the preferred embodiments for the present invention both for ease of manufacture and for control of discharges through the secondary path.

While the invention has been described in detail herein in accord with certain preferred embodiments thereof, many modifications and changes therein may be effected by those skilled in the art. Accordingly, it is intended by the appended claims to cover all such modifications and changes as fall within the true spirit and scope of the invention.

The invention claimed is:

1. A fluorescent lighting device comprising:
   an evacuable, light-transmissive envelope formed from substantially two sheets, at least one of said sheets having channels therein which define a main discharge path, one of said sheets also possessing at least one ridge disposed between said channels, the other of said sheets possessing a channel complementarily matching said ridge so as to define a secondary path exhibiting a higher resistance to electrical discharge current flow than said main discharge path;
   a phosphor disposed on the interior of said envelope;
   an ionizable medium disposed within said envelope; and
   at least one pair of electrodes disposed at opposite ends of said main discharge path.

2. The device of claim 1 in which the ratio of the length of said main discharge path to the diameter of said main discharge path is greater than 10.

3. A fluorescent lighting device comprising:
   an evacuable, light-transmissive envelope formed from substantially two sheets, at least one of said sheets having major channels therein which define a main discharge path, at least one of said sheets having at least one minor channel therein which, with said other sheet, defines a volume between said main channels and in gaseous communication therewith;
   a phosphor disposed on the interior of said envelope;
   an ionizable medium disposed within said envelope;
   at least a pair of electrodes disposed at opposite ends of said main discharge path; and
   an ion recombination enhancement material disposed within said volume.

4. The device of claim 3 in which said ion recombination enhancement material comprises material selected from the group consisting of glass fiber, glass wool, quartz fiber and quartz wool.

* * * * *